US008393922B2

(12) United States Patent
Bussieres et al.

(10) Patent No.: US 8,393,922 B2
(45) Date of Patent: Mar. 12, 2013

(54) CONNECTION SYSTEM ENABLING THE TIGHTENING TORQUE OF A SCREW TERMINAL TO BE INDICATED

(75) Inventors: Pierre Bussieres, La Tour du Pin (FR); David Couzon, Froges (FR); Bernard Loiacono, Seyssinet (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 39 days.

(21) Appl. No.: 13/064,669

(22) Filed: Apr. 7, 2011

(65) Prior Publication Data

US 2011/0269333 A1 Nov. 3, 2011

(30) Foreign Application Priority Data

Apr. 30, 2010 (FR) ..... 10 01843

(51) Int. Cl.
*H01R 4/36* (2006.01)

(52) U.S. Cl. ..... 439/811; 174/84 C

(58) Field of Classification Search ..... 439/488, 439/709, 801, 810–815; 174/40 CC, 84 C
See application file for complete search history.

(56) References Cited

U.S. PATENT DOCUMENTS

| | | | | |
|---|---|---|---|---|
| 4,929,198 | A * | 5/1990 | Strate et al. | 439/709 |
| 6,339,190 | B1 * | 1/2002 | Chung | 174/50 |
| 6,719,593 | B2 * | 4/2004 | Garcia et al. | 439/811 |
| 7,172,470 | B2 * | 2/2007 | Takaya et al. | 439/811 |
| 7,404,745 | B1 * | 7/2008 | Wu | 439/811 |
| 7,473,146 | B2 * | 1/2009 | Fuzetti et al. | 439/798 |
| 7,938,693 | B2 * | 5/2011 | Skowranek | 439/811 |
| 2002/0187685 | A1 | 12/2002 | Garcia et al. | 439/811 |

FOREIGN PATENT DOCUMENTS

| | | |
|---|---|---|
| DE | 10 2004 017101 | 7/2005 |
| EP | 1 271 697 | 1/2003 |
| EP | 1 280 238 | 1/2003 |
| EP | 1 531 519 | 5/2005 |
| FR | 2 758 212 | 7/1998 |

* cited by examiner

*Primary Examiner* — Thanh Tam Le
(74) *Attorney, Agent, or Firm* — Steptoe & Johnson LLP

(57) ABSTRACT

A screw terminal with creep compensation comprises a pressure device enabling a clamping energy of the terminal to be stored. According to the invention, means for detecting the tightening torque enable the user to identify the force required for connection and to check that the creep is in fact compensated. The means for detecting comprise an element securedly affixed to the pressure device and an element securedly affixed to a wall of the housing in which the terminal is fitted, the distance between the two elements being determined by means enabling indicating means to be actuated when the distance is smaller than a threshold corresponding to a predetermined tightening torque.

17 Claims, 1 Drawing Sheet

CONNECTION SYSTEM ENABLING THE TIGHTENING TORQUE OF A SCREW TERMINAL TO BE INDICATED

BACKGROUND OF THE INVENTION

The invention relates to a screw terminal for connecting at least one electrical conductor to a conducting strip of an electrical equipment unit. The object of the invention is more precisely to guarantee effective clamping of a terminal with creep compensation. In particular, the invention relates to a terminal comprising a device for indicating the tightening torque of the screw.

STATE OF THE ART

Cable connection terminals can have a tendency to come loose after a long period of service and this loosening gives rise to large heat rises in electrical equipment units. To monitor this phenomenon in order to be able to perform any necessary retightening, document EP 1 531 519 thus proposes to add a system indicating the quality of tightening, in particular a lever taking two positions.

To prevent loosening itself, terminals in which means compensating creep have been developed. The document EP 1 271 697 thus presents a screw terminal comprising a connection tunnel equipped with a tapped hole, a screw collaborating with the tapped hole and a flexible pressure part which presses on the electrical conductor. The pressure part comprises a head strip and a pressure strip connected to one another by a flexible wing designed to store a clamping energy, the head strip being able to be solicited by the screw head and the pressure strip being able to be applied against one of the conductors to be connected. Due to the pressure exerted under the screw head, this application of pressure prevents the terminal from coming loose and/or enables the creep of the conductor clamped by the terminal to be compensated. To improve balancing of the terminal, the pressure part comprises two flexible wings symmetrical with respect to an axial plane of the screw and of concave shape.

By means of this system, the installation time can be very short while at the same time ensuring the quality of the wiring and guaranteeing continuity of service. However, the operator has no practical indication on the actual position of the screw, at all times, and remains sole judge as to the clamping force applied on the electrical conductor and therefore of the contact pressure. This lack of information may lead to a certain hesitation to the detriment of the time required to perform the operations. Moreover, due to the fact that no indication of the actual tightening torque is available, for fear of creep occurring, the operator may be led to check the tightness of the terminal clampings regularly, even though any creep has been compensated.

SUMMARY OF THE INVENTION

Among other advantages, the object of the invention is to palliate this shortcoming of the prior art terminal and to propose a system enabling the tightening torque of a terminal with creep compensation to be indicated.

In particular, the invention relates to detection means for detecting a tightening torque of a screw terminal equipped with a pressure device and located between walls, said means comprising an element securedly affixed to the pressure device and an element securedly affixed to a wall cooperating with one another to actuate indicating means when the tightening torque reaches a threshold.

According to the invention, the detection means form part of a connection system comprising a housing with insulating walls with which a terminal is associated that comprises a connection tunnel provided with a screw and with a pressure device of annular shape preferably captively coupled with the screw so as to be driven by the latter. The pressure device comprises a head strip secured to the screw and located opposite a pressure strip that is movable in the tunnel, as well as two symmetric concave wings that join the latter, the central part of the wings moving towards the walls of the terminal housing when the device is compressed between its head strip and its pressure strip, i.e. in particular when the screw is tightened onto a conductor and/or a connecting strip located in the tunnel. The pressure device is preferably conducting and provided with an insulating flap moving with the latter so as to blank off a hole for passage of a conductor of the housing.

A first detection element is located on a wall of the housing and a second element is fitted on the adjacent wing, preferably at the level of the central part which deforms the most and/or on the insulating flap. Means enable a minimum threshold of the distance separating the two elements to be determined, said threshold corresponding to a predetermined tightening torque of the screw, i.e. a compressive force of the device, said means actuating indicating means, for example a light-emitting diode, depending on whether the threshold is reached or not. The two elements preferably come up against a stop when the predetermined tightening torque is reached, and contact between the two elements advantageously closes a power supply circuit of the indicating means. The first element can then comprise two conducting tracks extending parallel to the axis of the screw over a length covering at least the maximum displacement of the tunnel, and the second element a strip joining the two tracks or not.

The invention also relates to a connection system with the above-mentioned terminal, the housing and the detection means, the housing being able to form part of an electrical equipment unit at the level of one of its connection strips or be comprised in an independent case. The invention then relates to a terminal block that can accommodate several terminals and in particular comprise three housings and three tunnel terminals advantageously forming three integral connection systems.

More generally, the system for connecting an electrical equipment unit according to the invention comprises a housing delineated by insulating walls, a terminal comprising a connection tunnel and a cooperating screw for relative movement of the screw with respect to the tunnel, and a pressure device comprising two flexible wings joined to one another at one end by a head strip affixed to the screw and at the other end by a pressure strip located in the connection tunnel. The wings are symmetrical with respect to an axial plane of the screw and comprise a central part, such that the separation between the central parts of the wings increases when compression of the pressure device takes place between its head strip and its pressure strip so that said pressure device is able to store a clamping energy. The system according to the invention further comprises means for detecting a predetermined tightening torque of the screw comprising a first element securedly affixed to a wall and a second element securedly affixed to a wing, said wing and said wall being adjacent to one another when the terminal is fitted in place in the housing, means for determining the distance separating the first and second elements, indicating means coupled to the means for determining and indicating when said distance is smaller than or equal to a threshold distance.

According to a preferred embodiment, the first and second elements come into contact when the predetermined tightening torque is reached, said threshold distance being zero. The first and second elements can be conductive and form part of a power supply circuit of the indicating means so that the indicating means are supplied when the predetermined tightening torque is reached. For example the first element comprises two conducting tracks and the second element comprises a conducting strip. The second element is preferably located at the level of the central part of the wing and the first element extends in a direction parallel to the axis of relative movement of the terminal over a sufficient length to be facing the second element in all the relative positions of the terminal with respect to the housing. The second element can be fitted on an insulating flap fixed to a wing of the pressure device.

BRIEF DESCRIPTION OF THE DRAWINGS

Other advantages and features will become more clearly apparent from the following description of particular embodiments of the invention given for illustrative and in no way restrictive example purposes only, represented in the appended drawings.

DETAILED DESCRIPTION OF A PREFERRED EMBODIMENT

Figure 1A:
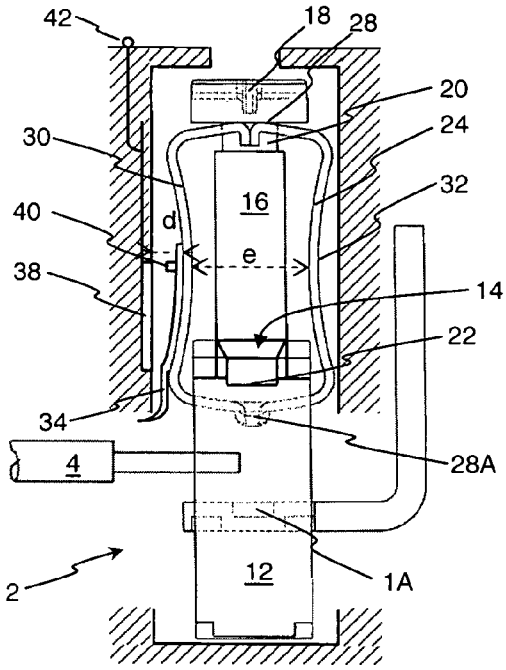
FIGS. 1A and 1B illustrate a connection system according to the invention in the rest position and in the clamped position.

For an electric equipment unit (not illustrated), a fixed connecting strip 1 is accessible via an opening 2 of the case so as to be able to associate one or more conductors 4 therewith by direct clamping. As illustrated in FIG. 1A, insulating walls 6 define a housing 8 inside the case, which housing is conventionally of rectangular parallelepipedic shape, provided with various arrangements so as to house a screw terminal 10 for connection to the fixed strip 1. The terminal 10 comprises a tunnel 12 formed by a cut and folded metal strip looped into a rigid ring defining a substantially rectangular passage which faces the access opening 2 of the case and in which the connecting strip 1 is positioned. On a small side substantially parallel to the fixed strip 1, the rigid tunnel 12 comprises a tapped hole 14 for a screw 16 to pass through, which thus moves perpendicularly to the strip 1 and enables clamping to be performed. The screw 16 comprises an operating head 18 extending a threaded rod, via a neck 20, the rod being terminated at its free end by a bearing seat 22 directly solicited for clamping a cable 4 onto the strip 1.

A pressure device 24 is coupled to the screw 16, preferably in captive manner, so as to move with the latter and to be solicited by the clamping. The device 24 is a flexible unitary part, usually made from metal, substantially closed on itself in the form of a ring and symmetrical with respect to an axial plane of the screw 16. A head strip 26 surrounds the neck 20 of the screw 16, under the head 18 of the latter, so as to ensure balanced clamping, and a pressure strip 28 can be applied on one of the conductors 1, 4 to be placed in contact, acting as interface with the seat 22 of the screw 16. On each side of the axis of the screw 16, a wing 30 joins the strips 26, 28 of the device 24 via a connection area determining a salient angle. The wings 30 are concave, with a central part 32 closer to the axis of the screw 16.

The pressure strip 28 can be curved to give the end part of the device 24 opposite the head strip 26 a general convex shape and/or to present embossments 28A collaborating with a withdrawn part 1A of the conducting 1 strip. The combination of the concaveness of the wings 30 and of the sloping or convex shape of the strips 26, 28 is designed for the pressure device 24 to be deformed by compression with a decreasing curvature when the pressure increases. The central parts 32 move away from one another.

Figure 1B:
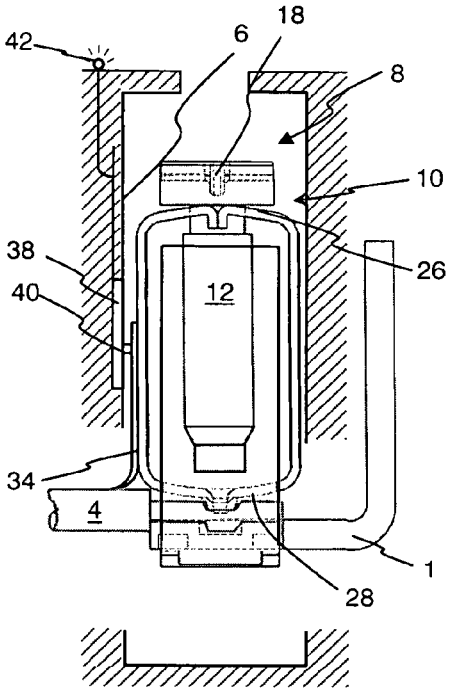

In particular, in the illustrated embodiment, cooperation of the screw thread with the tapped hole 14 means that rotation of the screw 16 results in translation of the tunnel 12 with respect to the housing 8 until its comes up against the stop formed by a surface of the fixed connection strip 1. In parallel, the screw 16 moves with respect to the tunnel 12 and housing 8 until the pressure strip 28 comes up against the stop formed by the opposite surface of the fixed strip 1. Continued rotation of the screw 16 then results in compression stressing of the pressure device 24, which leads to the concaveness of the wings 30 decreasing and the seat 22 of the screw 16 being applied against the surface of the pressure strip 28 opposite the fixed strip 1—FIG. 1B. The elastic force stored in the wings 30 contributes to preventing slackening of the screw 16 by nuisance rotation (action exerted by the head strip 20 on the head 18) and to compensating a clearance due to creep of the conductor 2, by movement of the pressure strip 28 relatively to the seat 22 of the screw 16. It should be noted in this respect that the head 18 biases the head strip 20 in compression, which enables the elastic limit of the device 24 to be respected.

Preferably, at rest, a small distance is provided between the bearing seat 22 of the screw 16 and the surface facing the pressure strip 28. The distance is determined so that compensation of the latter produces the desired level of stress of the pressure device 24. Advantageously, the head of the screw 16 presses on the head strip 20 in a region situated at a small distance from the axis of the screw 16 so as to create a leverage force which accentuates the torque exerted on the device 24.

An insulating flap 34 is advantageously fixed onto a wing 30 facing the insertion opening 2 of the cable 4. The flap 34 moves together with the pressure device 24 so as to partly mask the insertion opening 2 and thereby reduce the risks of nuisance contact.

The distance e between the internal surfaces of the central parts 32 of the wings 30 is minimal at rest; it is at least equal to and preferably slightly greater than the width of the tunnel 12 so that the tunnel 12 can slide freely within the pressure device 24. Preferably, in the clamped position, the distance e between the internal surfaces of the central parts 34 increases until the wings 30 take a shape having a nil or inversed concaveness.

According to the invention, when the recommended tightening torque is reached, the distance e between the internal surfaces of the wings 30 is maximal: means are provided to detect and indicate the predetermined minimum of the residual distance d between the central part 32 of one of the wings 30 and the adjacent wall 6 of the housing 8. When the distance d corresponding to this position is detected, an indication, which can be audible or preferably visual, enables the operator to know that his tightening is sufficient. This sole criterion suffices for connection to be made in reliable and rapid manner. Moreover, so long as the above-mentioned clamped position is indicated, the operator can recognize the reality of clamping of the screw 16 so as not to perform an operation involving retightening a screw 16 for a terminal 10 which is in fact correctly connected.

Detection of the minimum of distance d is preferably performed by fitting a stop system cooperating between the wall 6 and the wing 30, which, in addition to simplicity of detection, avoids too great stressing of the pressure device 24 and a too high tightening torque. The detection means thus comprise a first stop 38 on a wall 6 cooperating with a second stop element 40 on the adjacent wing 30. The detection means are of dry switch type and the two stop elements 38, 40 are conductors closing a supply circuit of the indicating means 42, for example a light-emitting diode, a controller input, safety circuit, etc.

The second element 40 located on the wing 30 can comprise a protuberance of said metal wing. The second element 40 is advantageously a conductor fitted on an insulating support so as to prevent any accidental contact between the wing 30 itself and the first element 38. In particular the second element 40 comprises a conducting strip fitted on the flap 34. For enhanced precision, it is preferred for the second element 40 to be located at the level of the central part 32 of the wing 30, which is subjected to the greatest strain when clamping is performed.

The first element 38, located on the adjacent wall 6, advantageously comprises two conducting tracks 44 insulated from one another, each track 44 being connected to the supply circuit of the indicating means 42. The distance separating the two tracks 44 is smaller than or equal to the width of the stop element strip 40 in the same direction. The tracks 44 advantageously extend parallel to the axis of the screw 16 over a length corresponding at least to the possible movement of the second element 40, i.e. wing 30/flap 34 with respect to wall 6. Other embodiments are possible.

Figure 2:
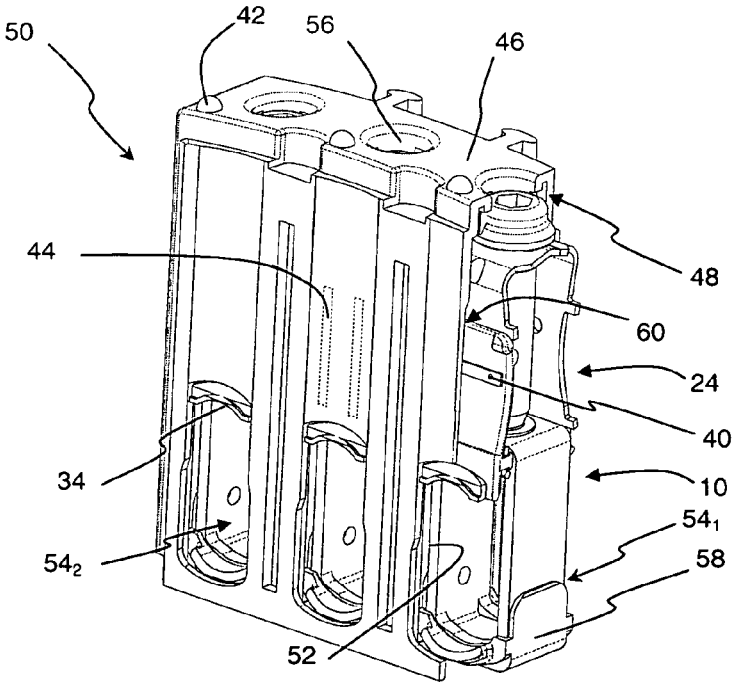
FIG. 2 shows a terminal block according to a preferred embodiment of the invention.

In a preferred embodiment illustrated in FIG. 2, the terminal 10 according to the invention is associated with an insulating case 46 housing 48 for the latter, said case 46 being inserted directly in a housing recess 8 of an electric equipment unit. Preferably several, and in particular three, terminals 10 are housed in a unitary case 46 to facilitate installation of three-phase equipment units, by inserting a single terminal block 50 therein. In this embodiment, the terminal block 50 comprises an insulating case 46 provided with three housings 48 of square cross-section, insulated from one another by separating wall 52, each of the housings 48 comprising two openings $\mathbf{54}_i$ facing one another at the level of one end and on two surfaces orthogonal to the separating wall 52, one opening $\mathbf{54}_1$ being designed for the fixed strip 1 to pass through and the other opening $\mathbf{54}_2$ being designed to face an opening 2 for the equipment unit to pass through. At the level of the end adjacent to the opening $\mathbf{54}_i$, the surface orthogonal to the side walls 52 and comprising the openings $\mathbf{54}_i$ is hollowed out at the level of each housing 48 to allow passage of a terminal 10 as described in the foregoing, and the opposite dace is provided with a hole 56 enabling screw 16 to be actuated. The surface of the tunnel 12 of the terminal 10 accessible from the recess of the case 46 is advantageously associated with an insulating cover 58 so as to close the housing 48 of the terminal block 50. The inner surface of wall 60, preferably the wall comprising the passage opening $\mathbf{54}_2$, is provided with the first element 40 of the means for detecting the tightening torque.

Although the invention has been described with reference to a terminal 10 in which the tunnel 12 and screw 16 are movable with respect to the housing 8, 48 in which the terminal 10 is placed, it is by no means limited thereto. In particular it is possible with the system and/or terminal block 50 according to the invention to have a tunnel 12 or a screw 16 fitted in fixed manner with respect to the walls 6. The terminal 10 can enable a conductor 4 to be clamped between the bearing seat 22 and the fixed strip 1 or on the other side of the strip 1, or one conductor to be fixed on each side. It is further possible to achieve the switch circuit of the indicating means 42 using the pressure device 24 as a bridge connecting two first elements 38 located on the opposite two walls 48 of a terminal block 50, or any other alternative. Other means for determining the distance between the two elements 38, 40 can be envisaged. In particular it is possible to use means enabling two threshold distances to be identified so as to inform the user that clamping is desirable or compulsory.

The invention claimed is:

1. A connection system of an electrical equipment unit comprising:

a housing having insulating walls;

a terminal comprising a connection tunnel and a screw cooperating for a relative movement of the screw with respect to the tunnel;

a pressure device comprising two flexible wings joined to one another at one end by a head strip secured to the screw and at the other end by a pressure strip located in the connection tunnel, said wings being symmetrical with respect to an axial plane of the screw and each comprising a central part, such that the distance between the central parts of the wings increases when the pressure device is compressed between the head strip and the pressure strip so that said pressure device is able to store a clamping energy;

means for detecting a predetermined tightening torque of the screw comprising a first element securedly affixed to one of said walls and a second element securedly affixed to one of said wings, said one wing and said one wall being adjacent to one another when the terminal is in place in the housing, means for detecting a distance separating the first and second elements, and indicating means coupled with the means for detecting, for indicating when said distance is smaller than or equal to a threshold distance; and wherein the second element is located at a level along the central part and wherein the first element extends parallel to the axis of relative movement of the terminal over a sufficient length to be facing the second element in all the relative positions of the terminal with respect to the housing.

2. The connection system according to claim 1 wherein the first and second elements come into contact when the predetermined tightening torque is reached, said threshold distance being nil.

3. The connection system according to claim 2 wherein the first and second elements are conductive and form part of a power supply circuit of the indicating means so that the indicating means are supplied when the predetermined tightening torque is reached.

4. The connection system according to claim 3 wherein the first element comprises two conducting tracks and the second element comprises a conducting strip.

5. The connection system according to claim 1 further comprising an insulating flap fixed to said one wing of the pressure device.

6. The connection system according to claim 5 wherein the second element is fitted on the flap.

7. The connection system according to claim 1 wherein the first and second elements come into contact when the predetermined tightening torque is reached, said threshold distance being nil, and further comprising an insulating flap fixed to said one wing of the pressure device, the second element being fitted on the flap.

8. The connection system according to claim 1 further comprising an insulating flap fixed to said one wing of the pressure device.

9. The connection system according to claim 8 wherein the first and second elements are conductive and form part of a power supply circuit of the indicating means so that the indicating means are supplied when the predetermined tightening torque is reached.

10. An electrical equipment unit comprising at least one connection system according to claim 1, and a case wherein the housing of the connection system is a portion of said case which includes the connection tunnel, additionally comprising a fixed connection strip in the connection tunnel.

11. A connection terminal block comprising an insulating case and at least one connection system according to claim 1, wherein the housing of the connection system is in the case, said housing being of rectangular parallelepipedic shape with a surface comprising a hole for actuating the screw, the opposite surface comprising a recess for passage of the terminal of the connection system, and one of the surfaces having therein an access opening for a conductor to be connected.

12. The terminal block according to claim 11 wherein the first and second elements come into contact when the predetermined tightening torque is reached, said threshold distance being nil.

13. The terminal block according to claim 11 comprising three connection systems.

14. An electrical equipment unit comprising a case with an housing arrangement having insulating walls, said housing arrangement additionally comprising a fixed connection strip and a terminal comprising a connection tunnel wherein the connection strip is located and a screw cooperating for a relative movement of the screw with respect to the tunnel, wherein the terminal comprises: a pressure device with two flexible wings joined to one another at one end by a head strip secured to the screw and at the other end by a pressure strip located in the connection tunnel, said wings being symmetrical with respect to an axial plane of the screw and each comprising a central part, such that the distance between the central parts of the wings increases when the pressure device is compressed between the head strip and the pressure strip so that said pressure device is able to store a clamping energy; means for detecting a predetermined tightening torque of the screw comprising a first element securedly affixed to one of said walls and a second element securedly affixed to one of said wings, said one wing and said one wall being adjacent to one another, means for indicating when the first and second elements come into contact when the predetermined tightening torque is reached; and wherein the second element is located at a level along the central part and wherein the first element extends parallel to the axis of relative movement of the terminal over a sufficient length to be facing the second element in all the relative positions of the terminal with respect to the housing.

15. A connection terminal block comprising:

an insulating case comprising three housings, each housing comprising a terminal, a connection tunnel and a screw cooperating for relative movement of the screw with respect to the tunnel, wherein the each housing is of rectangular parallelepipedic shape with a surface having a hole therein for access to permit actuating the screw, an opposite surface comprising a recess for passage of the terminal, and one of the surfaces having therein an access opening for a connection conductor to pass through;

three pressure devices each associated with one of the three housing and comprising two flexible wings joined to one another at one end by a head strip secured to the screw in the associated housing, and at other end by a pressure strip located in the connection tunnel of the associated housing, said wings being symmetrical with respect to an axial plane of the screw and each wing comprising a central part, such that the distance between the central parts of the wings increases when the pressure device is compressed between the head strip and the pressure strip so that said pressure device is able to store a clamping energy;

means for detecting a predetermined tightening torque of the screw comprising a first element securedly affixed to a surface of the housing of said pressure device, and a second element securedly affixed to a wing of said pressure device, said wing and said surface being adjacent to one another; and means for indicating when the first and second elements come into contact when the predetermined tightening torque is reached;

wherein the second element is located at a level along the central part and wherein the first element extends parallel to the axis of relative movement of the terminal over a sufficient length to be facing the second element in all the relative positions of the terminal with respect to the housing.

16. The connection system according to claim 15 wherein the means for detecting a predetermined tightening torque of the screw, the means for detecting the distance and the indicating means of each terminal are substantially identical.

17. The connection system according to claim 16 further comprising an insulating flap fixed to one of the wings of one of the pressure devices.

* * * * *